United States Patent [19]

Uemura

[11] Patent Number: 4,462,757

[45] Date of Patent: Jul. 31, 1984

[54] FAN BLADE STRUCTURE

[75] Inventor: Masakazu Uemura, Yokosuka, Japan

[73] Assignee: Nissan Motor Company, Limited, Kanagawa, Japan

[21] Appl. No.: 430,672

[22] Filed: Sep. 30, 1982

[30] Foreign Application Priority Data

Oct. 12, 1981 [JP] Japan ..... 56-162334

[51] Int. Cl.[3] ..... F04D 29/32; F04D 29/52

[52] U.S. Cl. ..... 416/244 R; 416/245 R

[58] Field of Search ..... 416/245 R, 188, 214, 416/241 A, 244 R, 244 A; 403/337

[56] References Cited

U.S. PATENT DOCUMENTS 3,023,035 2/1962 Kelley ..... 416/244 R X
4,321,011 3/1982 Hori et al. ..... 416/241 A X

FOREIGN PATENT DOCUMENTS 2038958 7/1980 United Kingdom ..... 416/245 R
414426 8/1974 U.S.S.R. ..... 416/188

*Primary Examiner*—Stephen Marcus
*Assistant Examiner*—Joseph M. Pitko

[57] ABSTRACT

A fan blade structure of a fan such as, for example, a mixed-flow cooling fan for an automotive internal combustion engine, comprising a blade member having an annular boss portion having a cylindrical outer peripheral surface and a plurality of blade portions integral with and radially projecting outwardly from the boss portion, and a collar member secured to the blade member and having a frusto-conical outer wall portion surrounding the boss portion of the blade member and tapering toward the front end of the boss portion and an inner flange portion circumferentially extending along the boss portion of the blade member and attached to the rear end face of the boss portion, the outer wall portion of the collar member being formed with slots angled and configured conformingly to radially inner end portions of the blade portions, respectively, of the blade member and open at the radially reduced axial end of the collar member.

8 Claims, 5 Drawing Figures

FAN BLADE STRUCTURE

FIELD OF THE INVENTION

The present invention relates to a fan blade structure of a fan such as a mixed-flow cooling fan to be used for the air cooling of an automotive internal combustion engine.

SUMMARY OF THE INVENTION

In accordance with the present invention, there is provided a fan blade structure of a fan such as, for example, a mixed-flow cooling fan for an automotive internal combustion engine, comprising, in combination, a unitary blade member comprising an annular boss portion having a cylindrical outer peripheral surface and a plurality of blade portions integral with and radially projecting outwardly from the boss portion; and a collar member secured to the blade member and comprising a frusto-conical outer wall portion coaxially surrounding the boss portion of the blade member and tapering toward the front end of the boss portion and an inner flange portion circumferentially extending along the boss portion of the blade member and securely attached to the rear end face of the boss portion of the blade member, the outer wall portion of the collar member being formed with a plurality of slots which are angled and configured conformingly to radially inner end portions of the blade portions, respectively, of the blade member and which are open at the radially reduced axial end of the collar member. In the fan blade structure according to the present invention, the blade member may further comprise an inner flange portion circumferentially extending along the boss portion of the blade member and the collar member may also further comprise an annular rear end portion radially intervening between the outer wall portion and the inner flange portion of the collar member and securely attached to the rear end face of the inner flange portion of the blade member. The rear end portion of the collar member may merge into either the radially enlarged axial end or the radially reduced end of the outer wall portion of the collar member.

BRIEF DESCRIPTION OF THE DRAWINGS

The drawbacks of a prior-art fan blade structure and the features and advantages of a fan blade structure according to the present invention will be more clearly understood from the following description taken in conjunction with the accompanying drawings in which.

DESCRIPTION OF THE PRIOR ART

Figure 1:
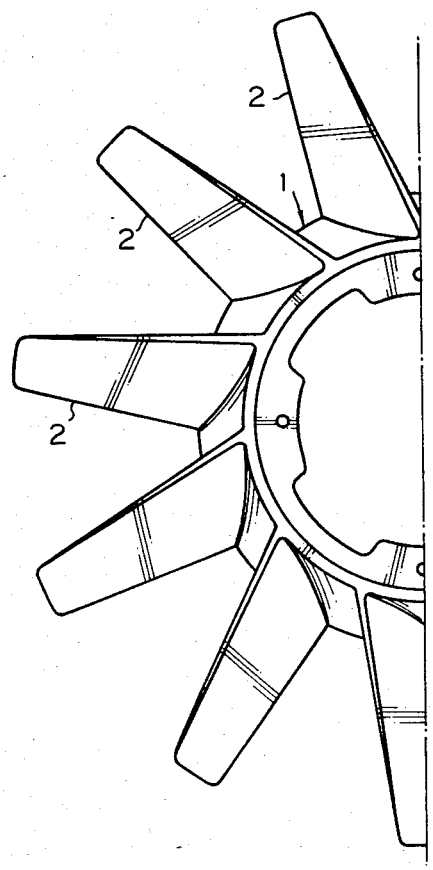
FIG. 1 PRIOR ART
FIG. 1 is a fragmentary front end view showing a diametrical half of a prior-art mixed-flow cooling fan used for the air cooling of an automotive internal combustion engine.
Figure 2:
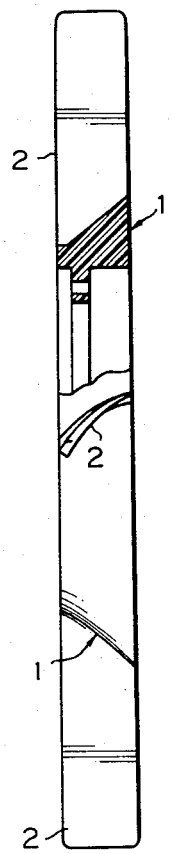
FIG. 2 PRIOR ART
FIG. 2 is a side view partly in cross-section of the fan blade structure shown in FIG. 1.

Referring to FIGS. 1 and 2 of the drawings, a known fan blade structure of a mixed-flow cooling fan used for the cooling of an automotive internal combustion engine consists of an annular boss portion 1 and a plurality of blade portions 2 integral with and radially projecting outwardly from the boss portion 1. The boss portion 1 has a frusto-conical outer peripheral surface tapering toward the front or windward end of the mixed-flow as will be better seen from FIG. 2 so as to reduce noises and provide an increased draft of air. The fan blade structure thus configured is generally manufactured by injection molding of a synthetic resin.

The fan blade structure of the above described nature can not be injection molded in an ordinary two-section split die since the blade portions 2 have undercuts on the rear, viz., leeward sides thereof by reason of the frusto-conical configuration of the boss portion 1. The fan blade structure is thus usually injection molded with use of a die having a number of sliding cores which can be ejected from the die unit in radial directions to form the individual blade portions 2. The die used for the manufacture of the prior-art fan blade structure is for this reason extremely costly and requires a number of steps for producing the fan blade structure.

In an attempt to overcome these problems, a mixed-flow cooling fan is known which uses a fan blade structure having a boss portion constructed by members which are formed separately of one another. Such a fan blade structure is disclosed in, for example, Japanese Provisional Patent Publication No. 55-87895 and can be manufactured with use of an ordinary two-section split die. In the prior-art fan blade structure therein taught, the boss portion is composed of a generally cylindrical member and a plurality of segments which are screwed or otherwise securely fitted to the cylindrical member on the rear sides of the blade portions so as to form a frusto-conical outer peripheral surface similar to that of the boss portion 1 of the fan blade structure shown in FIGS. 1 and 2. A drawback is however still encountered in a prior-art fan blade structure of this nature in that the component members of the structure have extreme irregularities of thickness and are, for this reason, liable to produce unusual stresses after the blade structure is molded. A mixed-flow cooling fan using such a fan blade structure is not acceptable where the speed of rotation is an important requirement of the fan as in the case of a mixed-flow cooling fan for an automotive internal combustion engine.

The present invention contemplates provision of an improved fan blade structure which is free from all these drawbacks that have been inherent in known fan blade structures for use in mixed-flow cooling fans. It should however be borne in mind that a fan blade structure proposed by the present invention is not necessarily intended for use in a cooling fan of the mixed-flow type but is applicable to any other types of fans or to blowers and exhausters.

DESCRIPTION OF THE PREFERRED EMBODIMENTS

Figure 3:
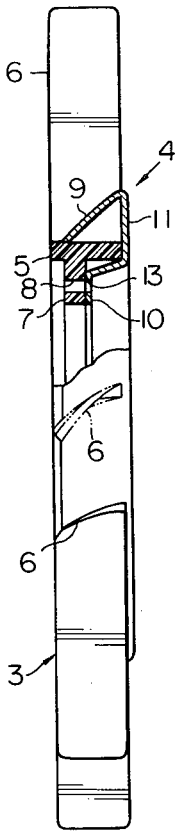
FIG. 3 is a view similar to FIG. 2 but showing a preferred embodiment of a fan blade structure according to the present invention.

Referring to FIG. 3 of the drawings, a fan blade structure embodying the present invention comprises of a unitary blade member 3 and an annular collar member 4. The blade member 3 has an annular boss portion 5 having a cylindrical outer peripheral surface and a plurality of blade portions 6 integral with and radially projecting outwardly from the boss portion 1. The blade member 3 as a whole is constructed of, for example, a synthetic resin and is, thus, essentially similar in itself to a known fan blade structure or member having a cylindrical boss portion. The blade member 3 of the fan blade structure embodying the present invention can therefore be injection molded with use of an ordinary or existing two-section split die. The boss portion 5 further has an inner flange portion 7 circumferentially extending along the boss portion 5 and formed with a suitable number of screw holes 8 elongated in directions parallel with the center axis of the boss portion 5. On the other hand, the collar member 4 has a frusto-conical outer wall portion 9 coaxially surrounding the boss portion 5 of the blade member 3 and tapering, viz., radially reduced toward the front or windward end of the boss portion 5 and an inner flange portion 10 circumferentially extending along the inner flange portion 7 of the blade member 3 and closely attached to the rear end face of the inner flange portion 7. The collar member 4 further has an annular rear end portion 11 radially intervening between the outer wall portion 9 and the inner flange portion 10 and closely attached to the rear end face of the boss portion 5 of the blade member 3. The outer wall portion 9 is formed with a plurality of slots 12 which conform in number to the blade portions 6 of the blade member 3 and which are open at the radially reduced axial end of the collar member 4 as will be better seen from FIG. 4 of the drawings. The individual slots 12 in the outer wall portion 9 are angled and configured conformingly to radially inner end portions of the blade portions 6, respectively, of the blade member 3. On the other hand, the inner flange portion 10 of the collar member 4 is formed with screw holes 13 axially aligned with the screw holes 8, respectively, in the inner flange portion 7 of the blade member 3 and is fixedly attached to the flange portion 7 by means of screws (not shown) passed through the screw holes 13 and 8. The collar member 4 is constructed of a metal or a synthetic resin.

To assemble together the blade and collar members 3 and 4 thus configured, the collar member 4 is first fitted to the blade member 3 so that the blade portions 6 of the blade member 3 are respectively received in the slots 12 in the outer wall portion 9 of the collar member 4 with the inner flange portion 10 of the collar member 4 attached to the rear face of the inner flange portion 7 of the blade member 3. The inner flange portion 10 of the collar member 4 is then secured to the flange portion 7 of the blade member 3 by driving screws through the screw holes 13 in the flange portion 10 of the collar member 4 into the aligned screw holes 8 in the flange portion 7 of the blade member 3.

The fan blade structure constructed as above described is advantageous not only in that the blade member 3 can be easily and economically injection molded by the use of an ordinary or existing two-section split die as previously noted but in that the boss portion 5 has no significant irregularities of thickness and is thus unlikely to produce unusual stresses after the blade member 3 is molded.

Figure 4:
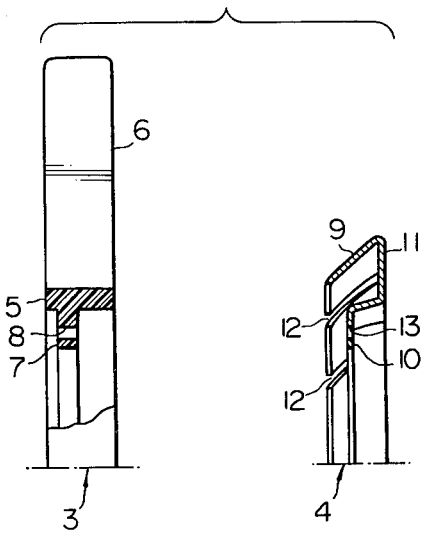
FIG. 4 is a fragmentary cross sectional view showing diametrical halves of the blade and collar members constituting the embodiment illustrated in FIG. 3.
Figure 5:
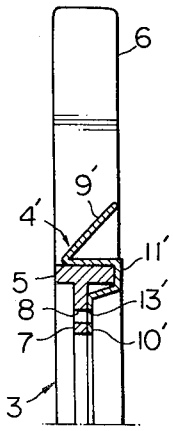
FIG. 5 is a fragmentary cross sectional view showing a diametrical half of a modification of the embodiment illustrated in FIG. 3.

In FIG. 5 of the drawings is shown a modification of the fan blade structure hereinbefore described with reference to FIGS. 3 and 4. In the fan blade structure shown in FIG. 5, the collar member, now designated in its entirety by 4', is essentially similar in configuration to the collar member 4 of the above described embodiment and, thus, has a frusto-conical outer wall portion 9', an annular inner flange portion 10' and an annular rear end portion 11' similar to their respective counterparts in the embodiment of FIGS. 3 and 4. The inner flange portion 10' of the collar member 4' is formed with screw holes 13' and is closely attached to the inner flange portion 7 of the blade member 3 by means of screws (not shown). While, however, the rear end portion 11 of the collar member 4 in the fan blade structure shown in FIGS. 3 and 4 merges into the radially enlarged axial end of the outer wall portion 9, the rear end portion 11' intervening between the outer wall portion 9' and the inner flange portion 10' of the collar member 4' in the fan blade structure shown in FIG. 5 merges into the radially reduced axial end of the outer wall portion 9'. The collar member 4' in the second embodiment may be constructed of metal or a synthetic resin. If the collar member 4' is to be constructed of a synthetic resin, the outer wall portion 9' may be constituted by a solid wall portion having a triangular axial section to fill up the groove formed between the outer wall portion 9' and the rear end portion 11' of the collar member 4'.

What is claimed is:

1. A fan blade structure, comprising in combination a unitary blade member comprising an annular boss portion having a cylindrical outer periphery surface and a plurality of blade portions integral with and radially projecting outwardly from the boss portion; and a collar member secured to said blade member, the collar member comprising a frusto-conical outer wall portion coaxially surrounding the boss portion of the blade member and tapering toward the front end of the boss portion and an inner flange portion circumferentially extending along the boss portion of the blade member and securely attached to the rear end face of the boss portion of said blade member, said outer wall portion having a radially enlarged axial end and a radially reduced axial end and being formed with a plurality of slots which are angled and configured conformingly to radially inner end portions of said blade portions, respectively, of the blade member and which are open at the radially reduced axial end of the collar member, said blade member further comprising an inner flange portion circumferentially extending along the boss portion of the blade member, and said collar member further comprising an annular rear end portion radially intervening between the outer wall portion and the inner flange portion of the collar member and securely attached to the rear end face of the inner flange portion of the blade member.

2. A fan blade structure as set forth in claim 1, in which said inner flange portion of the blade member is formed with a plurality of screw holes elongated in directions parallel with the center axis of the boss portion of the blade member and in which said inner flange portion of the collar member is formed with screw holes axially aligned with the screw holes, respectively, in the inner flange portion of the blade member and is fixedly attached to the flange portion by means of screws passed through the screw holes in the inner flange portion of the collar member and the screw holes in the inner flange portion of the blade member.

3. A fan blade structure as set forth in claim 1, or 2, in which the rear end portion of said collar member merges into the radially enlarged axial end of the outer wall portion of the collar member.

4. A fan blade structure as set forth in claim 1, or 2, in which the rear end portion of said collar member merges into the radially reduced axial end of the outer wall portion of the collar member.

5. A fan blade structure as set forth in claim 1, or 2, in which said blade member is constructed of a synthetic resin.

6. A fan blade structure as set forth in claim 5, in which said collar member is constructed of a metal.

7. A fan blade structure as set forth in claim 5, in which said collar member is constructed of a synthetic resin.

8. A fan blade structure as set forth in claim 5, in which the outer wall portion of said collar member is constituted by a solid wall portion having a substantially triangular axial section.

* * * * *